US012571121B2

(12) United States Patent
Nakajima et al.

(10) Patent No.: US 12,571,121 B2
(45) Date of Patent: Mar. 10, 2026

(54) SURFACE-TREATED ALUMINUM MATERIAL AND METHOD FOR PRODUCING THE SAME

(71) Applicant: UACJ CORPORATION, Tokyo (JP)

(72) Inventors: Daiki Nakajima, Tokyo (JP); Sohei Saito, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 82 days.

(21) Appl. No.: 18/146,618

(22) Filed: Dec. 27, 2022

(65) Prior Publication Data

US 2023/0127403 A1 Apr. 27, 2023

Related U.S. Application Data

(63) Continuation of application No. PCT/JP2021/023769, filed on Jun. 23, 2021.

(30) Foreign Application Priority Data

Jul. 2, 2020 (JP) ..... 2020-115109

(51) Int. Cl.
*C25D 11/04* (2006.01)
*C25D 11/24* (2006.01)

(52) U.S. Cl.
CPC ..... *C25D 11/04* (2013.01); *C25D 11/246* (2013.01)

(58) Field of Classification Search
None
See application file for complete search history.

(56) References Cited

U.S. PATENT DOCUMENTS

2007/0267299 A1* 11/2007 Mitani ..... C25D 11/06 205/222
2016/0194779 A1 7/2016 Umemoto et al.

FOREIGN PATENT DOCUMENTS

| | | | | |
|---|---|---|---|---|
| JP | S574716 | B2 | | 1/1982 |
| JP | H11207860 | A | | 8/1999 |
| JP | 2010000679 | A | * | 1/2010 |
| JP | 2015025281 | A | | 2/2015 |
| JP | 2015102608 | A | | 6/2015 |
| JP | 7609577 | B2 | | 12/2024 |

OTHER PUBLICATIONS

Hasegawa, S., Aluminum Material and Its Manufacturing Method, Jan. 7, 2010, machine translation of JP2010-000679 (Year: 2010).*
[English translation] Notice of Reasons for Refusal for Japanese Patent Application No. 2020-115109 dated Aug. 7, 2024, pp. all.
[English Translation] International Search Report and Written Opinion for International Patent Application No. PCT/JP2021/023769 dated Aug. 31, 2021, pp. all.

(Continued)

*Primary Examiner* — Chinessa T. Golden
(74) *Attorney, Agent, or Firm* — Dorsey & Whitney LLP

(57) ABSTRACT

The surface-treated aluminum material includes an aluminum material and an oxide film formed on at least part of a surface of the aluminum material, and when a perimeter and an area of a void on a surface of the oxide film are represented by L and S, respectively, an undulation degree of the void defined as $L^2/S\times(1/4\pi)$ is 2.5 or more.

4 Claims, 1 Drawing Sheet

(56) References Cited

OTHER PUBLICATIONS

International Preliminary Report on Patentability for International Patent Application No. PCT/JP2021/023769 dated Dec. 13, 2022, pp. all.
[English Translation] First Office Action mailed Oct. 29, 2024 in TW Application No. 110123919; pp. all.
First Office Action for Chinese Patent Application No. 202180045959.5 dated Jan. 17, 2025, pp. all.
Second Office Action mailed Aug. 14, 2025 in CN Application No. 202180045959.5; pp. all.
First Office Action dated Dec. 5, 2025 in the corresponding MY application No. PI2022007594, p. 4.
English Translation and First Office Action dated Nov. 21, 2025 in the corresponding KR application No. 10-2023-7001387; p. 11.

* cited by examiner

SURFACE-TREATED ALUMINUM MATERIAL AND METHOD FOR PRODUCING THE SAME

CROSS REFERENCE TO RELATED APPLICATIONS

The present application is continuation application of International Patent Application No. PCT/JP2021/023769 filed on Jun. 23, 2021, which claims the benefit of Japanese Patent Application No. 2020-115109, filed on Jul. 2, 2020. The contents of these applications are incorporated herein by reference in their entirety.

TECHNICAL FIELD

The present disclosure relates to a pure aluminum material or an aluminum alloy material (hereinafter, referred to as "aluminum material") which is subjected to surface treatment, and specifically, to a surface-treated aluminum material.

BACKGROUND ART

Since aluminum materials are lightweight and have appropriate mechanical properties, and have features excellent in aesthetics, electrical conductivity, heat dissipation, corrosion resistance, and recyclability, they are used for a variety of structural materials, heat-exchange members, containers, packaging, electronic equipment, machinery, and other applications.

These aluminum materials are often used with imparted or improved properties such as corrosion resistance, an insulating property, close adhesion, an antibacterial property, and wear resistance, by applying the surface treatment on a portion or all of them.

In recent years, further, there has been progress in resource saving and energy saving mainly in the automobile industry, and when applying the aluminum material to structural members, structural members have been proposed in which a portion or all of the aluminum material is bonded to a resin to further reduce weight. Since these structural members are used for equipment for transportation, high close adhesion durability in an air environment and a corrosive environment is required.

In producing a member in which the aluminum material and the resin are bonded like this, and a coated member, too, the surface treatment of the aluminum material is required to improve close adhesion between the aluminum material and the resin or a coated film. As such a surface treatment method, for example, in Japanese Patent Application Laid-Open No. 2015-25281, an alkaline alternating current electrolysis method has been proposed. Namely, in the method of Japanese Patent Application Laid-Open No. 2015-25281, the alternating current electrolytic treatment is performed for 5 to 60 seconds of electrolysis time by using an alkaline solution having a liquid temperature of 30 to 90° C. and a pH of 9 to 13, and using a waveform having an anode peak voltage of 25 to 200 V at an end of the electrolysis and the anode peak voltage of 0.1 to 25 V at an initial stage of the electrolysis. This yields an aluminum material on which an oxide film having a thickness of 50 to 1,000 nm is formed in Japanese Patent Application Laid-Open No. 2015-25281.

In producing a composite material of an aluminum material/thermoplastic resin in which the aluminum material and the thermoplastic resin etc. are strongly bonded, a chemical treatment method of the aluminum material by utilizing an etching action of an aqueous solution has also been proposed such as that in Japanese Patent Application Laid-Open No. 2015-102608. Namely, in the method of Japanese Patent Application Laid-Open No. 2015-102608, by immersing the aluminum material in the aqueous solution having the etching action on an appropriate condition, or spraying such a solution to a surface of the aluminum material, a plurality of recessed parts are formed on the surface of the aluminum material; among the plurality of the recessed parts, a recessed part 1 having a maximum pore diameter of 10 μm or more, and a maximum depth of 5 μm or more in a cross section along the maximum pore diameter length is defined as a specific recessed part; and when the sum L (mm) of perimeters of the specific recessed parts present in any 1 mm square on a roughened surface meets a relationship of $0.10\ \text{mm} \leq L \leq 0.35\ \text{mm}$, this aluminum material is composited with the thermoplastic resin having an apparent elastic modulus $E=S/\varepsilon$ (MPa/%) that meets a relationship of $0.0050 \leq E \leq 0.0380$, wherein S (MPa) is tensile break strength, and E (%) is tensile break elongation.

Further, in a method of Japanese Patent Application Laid-Open No. 11-207860, by forming an anodic oxide film formed with a thickness of 0.1 to 1 μm, in which an area of a region having a pore of 10 nm or more in diameter is 75% or more of the total area, on aluminum or an aluminum alloy plate, even if performing drawing working or drawing ironing working on a harsh condition such as a drawing ratio of 2.5 or more after forming the thermoplastic resin film on this anodic oxide film, a material that the thermoplastic resin film is not peeled from the aluminum or the aluminum alloy plate is obtained.

In the conventional arts described above, in the surface treatment using the alternating current electrolysis of Japanese Patent Application Laid-Open No. 2015-25281, there has been a problem in electrolytic efficiency because current used for formation of the oxide film is about a half of an electrolytic current.

Further, in the method of forming anodized aluminum on an aluminum surface of Japanese Patent Application Laid-Open No. 11-207860, since strength is insufficient when measuring tape peeling strength using an adhesive tape, further improvement has been required.

SUMMARY OF DISCLOSURE

Technical Problem

As a result of intensive studies to solve the problems described above, the present inventors have found that oxide having undulation morphology is formed on a surface of an aluminum material by causing formation and chemical dissolution of an oxide film at the same time, to enhance an anchoring effect of the oxide film, thereby expressing high close adhesion between the aluminum material and other materials.

Solution to Problem

That is, subject matter of the present disclosure is as follows.

[1] A surface-treated aluminum material including an aluminum material and an oxide film formed on at least part of a surface of the aluminum material, wherein, when a perimeter and an area of a void on a surface of the oxide film are represented by L and S, respectively, an undulation degree of the void defined as $L^2/S \times (1/4\pi)$ is 2.5 or more.

[2] The surface-treated aluminum material according to 1, wherein a diameter of the void is 15 to 65 nm in terms of a circle equivalent diameter.

[3] The surface-treated aluminum material according to 1, wherein an area occupying ratio of the void on the surface of the oxide film is 10 to 60%.

[4] The surface-treated aluminum material according to 1, further including a resin layer on the surface of the oxide film.

[5] The surface-treated aluminum material according to 1, wherein the oxide film includes a barrier type anodic oxide film layer formed on at least part of the surface of the aluminum material and an aluminum oxide film layer formed on the barrier type anodic oxide film layer, and wherein the void is located on a surface of the aluminum oxide film layer.

[6] A method for producing the surface-treated aluminum material according to 1, wherein an acid or alkaline aqueous solution having a liquid temperature of 30 to 90° C. is used as an electrolytic solution, and wherein the oxide film is formed by performing electrolytic treatment with respect to the aluminum material so that a current density is 10 $A/m^2$ or more and 3,000 $A/m^2$ or less.

Effects of Disclosure

A surface-treated aluminum material which is excellent in close adhesion with an adhesive film, and other materials of a resin, etc., and a method for producing the same can be provided.

DESCRIPTION OF EMBODIMENTS

Hereinafter, details of a surface-treated aluminum material of the present disclosure will be described in order.

A. Aluminum Material

As an aluminum material forming the surface-treated aluminum material with respect to one embodiment of the present disclosure (for example, 2 in FIG. 1 described later), pure aluminum or an aluminum alloy can be used. Components of the aluminum alloy are not particularly limited, and various alloys including alloys specified in JIS can be used. A shape of the aluminum material is not particularly limited, and a flat plate, and a rod, a wire, a cylinder, etc. having an arbitrary sectional shape, can be possible, and a method for producing these shapes is not particularly limited, and various methods that can stably form an oxide film can be preferably used.

B. Oxide Film

Figure 1:
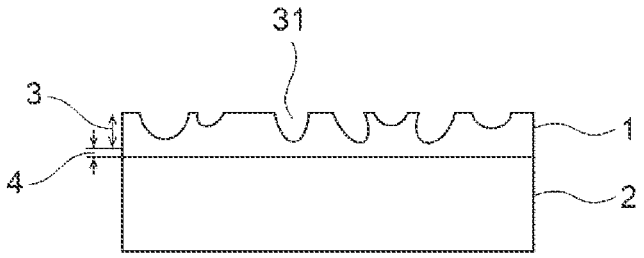
FIG. 1 A schematic diagram of a surface-treated aluminum material with respect to one embodiment of the present disclosure.

FIG. 1 is a schematic diagram of the surface-treated aluminum material with respect to one embodiment of the present disclosure. As shown in FIG. 1, in the surface-treated aluminum material with respect to one embodiment of the present disclosure, an oxide film 1 is formed on at least part of a surface of an aluminum material 2 (for example, in case of a flat plate aluminum material, on at least one of two surfaces opposing each other). In an example of FIG. 1, this oxide film 1 is composed of an aluminum oxide film layer 3 formed in a surface side of the oxide film and having a void 31 and a barrier type anodic oxide film layer 4 formed on the aluminum material 2 side.

B-1. As to Void

As shown in FIG. 1, in the aluminum oxide film layer 3, formed is the void 31 which is a small pore extending from its surface to the inside. On the surface of the aluminum oxide film layer 3, openings of all the small pores present with respect to a surface area (calculated by vertical× horizontal of a rectangle in case that a surface of the aluminum oxide film layer 3 is the rectangle) in which undulation is not considered, are specified as the void 31. In the present disclosure, an undulation degree of this void 31 is 2.5 or more. Here, when a perimeter and an area of the void 31 upon observing the surface of the oxide film 1 from a vertical direction to the surface are represented by L and S, respectively, "the undulation degree" is defined as $L^2/S\times(1/4\pi)$. Further, specific methods for measuring L and S will be described later. When this undulation degree is less than 2.5, close adhesion between the oxide film 1 and a bonded body is reduced, and for example, in case that the bonded body of a resin layer, etc. is further coated on the surface of the oxide film 1, an anchoring effect is lacking in bonding of the oxide film 1 and the bonded body. Therefore, when using an adhesive for the bonding of the oxide film 1 and the bonded body, fracture occurs at an interface portion between an outermost surface portion of the oxide film 1 and the adhesive. The undulation degree is preferably 2.5 to 10, more preferably 2.5 to 8, even more preferably 2.5 to 6. By letting the undulation degree be in a range described above, the oxide film 1 can have excellent close adhesion with the bonded body formed thereon.

As to the void 31 on the surface of the oxide film 1, its shapes are various such as a circle, an ellipse, a rectangle, a polygon, and an irregular shape, when observing from the vertical direction to the surface of the oxide film 1. Letting a perimeter of the void like this be equal to a perimeter of a perfect circle, a diameter of the perfect circle at that time is defined as a circle equivalent diameter. For example, in case that the shape of the void is the perfect circle, its perimeter is of course the same as the case of the perfect circle, and its diameter is, i.e., specified as the circle equivalent diameter. Instead, in case that the shape of the void is polygonal and the like, the perfect circle to which the perimeter is equal is specified and a diameter of the perfect circle is specified as the circle equivalent diameter.

The diameter of the void described above is preferably 15 nm or more and 65 nm or less, more preferably 25 nm or more and 60 nm or less, in terms of the circle equivalent diameter. When the circle equivalent diameter is 15 nm or more, good anchoring effect in the bonding between the oxide film and the bonded body of the resin, etc., is obtained, to achieve excellent close adhesion between the oxide film and the bonded body formed thereon. On the other hand, when the circle equivalent diameter is 65 nm or less, a catching structure to demonstrate the anchoring effect is suitably formed, to achieve the excellent close adhesion.

Further, on the surface of the oxide film (as one example, the aluminum oxide film layer 3), a proportion of the sum of areas of all the void 31 present occupying with respect to the surface area (of the surface on which the void is present) not considering the undulation is specified as an area occupying ratio of the void. Here, for example, when the surface on which the void is present is rectangle, a proportion of the sum of areas of all the void 31 present occupying with respect to the surface area calculated by vertical×horizontal of the rectangle is specified as the area occupying ratio of the void. In the present disclosure, this area occupying ratio of the void is preferably 10 to 60%, more preferably 15 to 55%. When this area occupying ratio is 10% or more, the good anchoring effect is obtained in the bonding between the oxide film and the bonded body, to achieve excellent close adhesion. When this area occupying ratio is 60% or less, the oxide film itself becomes to be difficult to cause cohesion failure, to achieve excellent close adhesion between the oxide film and the bonded body.

Further, the void 31 does not penetrate the barrier type anodic oxide film layer 4 in a depth direction in FIG. 1, but the void 31 may penetrate the barrier type anodic oxide film layer 4. Also, a position in the depth direction of a tip of the opposite side to the surface of the aluminum oxide film layer 3 of the void 31 is not particularly limited. However, the position of this tip is preferably 20 to 100%, more preferably 40 to 95%, of a thickness of the oxide film 1 from the surface of the oxide film 1. When the position of the tip is 20% or more, the good anchoring effect is obtained in the bonding between the oxide film and the bonded body, to achieve excellent close adhesion. The surface-treated aluminum material of one embodiment has further the resin layer on the surface of the oxide film. In this case, due to the anchoring effect of the oxide film surface as described above, the oxide film and the resin layer can have good close adhesion. A material forming the resin layer is not particularly limited, and for example, an epoxy resin, an ABS resin, a fluorine resin, etc., can be used.

C. Method for Producing Surface-Treated Aluminum Material

Hereinafter, a method for producing the surface-treated aluminum material with respect to one embodiment of the present disclosure will be described.

C-1. Electrode

One method for producing the surface-treated aluminum material of the present disclosure includes a method for forming the oxide film by letting the aluminum material to be surface-treated be one electrode, and performing electrolytic treatment using the other counter electrode under predetermined conditions.

Figure 2:
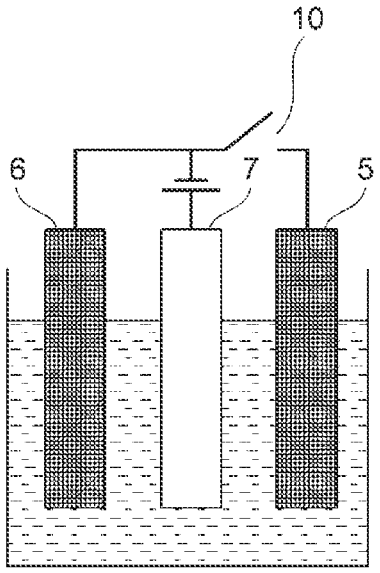
FIG. 2 A front view showing an electrolytic apparatus used for a method for producing the surface-treated aluminum material with respect to one embodiment of the present disclosure.

In one embodiment of the present disclosure, shapes of the aluminum material to be electrolytically treated and the counter electrode are not particularly limited, and, for example, as the counter electrode to the flat plate aluminum material, a plate-like shape is suitably used for even distance to the counter electrode and for stably forming the oxide film electrolytically treated. FIG. 2 is a schematic diagram representing a state that the electrolytic treatment is performed by letting the aluminum material be one electrode, and using the other counter electrode under the predetermined conditions. As shown in FIG. 2, counter electrode plates 5, 6 connected are prepared, and between these two counter electrode plates, an aluminum plate 7 to be surface-treated can be set up such that the both surfaces of the aluminum plate 7 are respectively parallel to surfaces of the counter electrode plates 5, 6. Dimensions of both surfaces of opposed aluminum material 7 and the counter electrode are set to mostly the same, and it is preferable that the electrolytic treatment is performed in a state that the both electrodes remain stationary. Further, in case that only one surface of the aluminum plate 7 to be surface-treated is treated, the only one surface of the aluminum material 7 (a left side surface of the aluminum material in the figure) can be treated, by attaching an insulating film onto one side of the aluminum material, after a counter electrode plate connecting switch 10 is turned off.

One electrode of a pair of electrodes used in the electrolytic treatment is the aluminum material to be surface-treated by the electrolytic treatment. As the other counter electrode, for example, a known electrode made of a material such as graphite, aluminum, gold, and titanium, can be used, but it is needed to use a material having properties that does not deteriorate with respect to components and temperatures of an electrolytic solution, and has excellent electrical conductivity, and further does not cause an electrochemical reaction by itself. From this point of view, a graphite electrode is suitably used as the counter electrode. This is because the graphite electrode is chemically stable, and inexpensive and readily available.

C-2. Electrolytic Treatment Conditions

As electrolytic treatment conditions, using the electrode of the above aluminum material and the counter electrode, and using an acid or alkaline aqueous solution of a liquid temperature of 30 to 90° C. as the electrolytic solution, the oxide film can be formed by performing the electrolytic treatment with respect to the aluminum material so that current density is 10 $A/m^2$ or more and 3,000 $A/m^2$ or less. Here, a current waveform when electrolyzing is not limited to any of an alternating current, a direct current, and a superimposed alternating current on direct current, but from the viewpoint of electrolytic efficiency, the aluminum material is preferably used as an anode and it is recommended to use the direct current so that the current density is 10 $A/m^2$ or more and 3,000 $A/m^2$ or less, more preferably 50 $A/m^2$ or more and 2,000 $A/m^2$ or less, even more preferably 100 $A/m^2$ or more and 1,000 $A/m^2$ or less, most preferably 100 $A/m^2$ or more and 300 $A/m^2$ or less. In cases of the alternating current and the superimposed alternating current on direct current, the current density is defined as a value that a current value at a time that an amount of electricity flowed per a unit area is largest, is divided by a reaction area, and it is recommended to use the current waveform so that the current density is preferably 10 $A/m^2$ or more and 3,000 $A/m^2$ or less, more preferably 50 $A/m^2$ or more and 2,000 $A/m^2$ or less, even more preferably 100 $A/m^2$ or more and 1,000 $A/m^2$ or less, most preferably 100 $A/m^2$ or more and 300 $A/m^2$ or less.

In one embodiment of the present disclosure, aqueous solutions that use the acid or alkaline aqueous solution as the electrolytic solution include inorganic acid such as sulfuric acid, phosphoric acid, arsenic acid, and selenic acid; organic acid such as oxalic acid, malonic acid, and etidronic acid; cyclic oxocarboxylic acid such as squaric acid and rhodizonic acid; borate such as sodium tetraborate; phosphate such as sodium phosphate, sodium hydrogen phosphate, sodium pyrophosphate, potassium pyrophosphate, and sodium metaphosphate; alkali metal hydroxide such as sodium hydroxide, and potassium hydroxide; carbonate such as sodium carbonate, sodium hydrogen carbonate, and potassium carbonate; a compound containing ammonium such as ammonium hydroxide, and ammonium pentaborate; or an aqueous solution containing a mixture of these. Normally, a concentration of these aqueous solutions is $1\times10^{-4}$ to 12 mol/liter, preferably $1\times10^{-2}$ to 1 mol/liter. Further, to these aqueous solutions, a surfactant, a chelating agent and the like may be added to enhance cleanliness of an aluminum material surface.

A temperature of the electrolytic solution used in one embodiment of the present disclosure is preferably 30 to 90° C., more preferably 35 to 85° C., even more preferably 60 to 80° C. When the electrolytic solution temperature is 30° C. or more, since etching power is favorable, the area occupying ratio of the void on the oxide film surface is enlarged, and the circle equivalent diameter of the void also can become sufficient one. On the other hand, when the electrolytic solution temperature is 90° C. or less, since the etching power is also favorable, there is no inducement of the cohesion failure of the oxide film. Further, the electrolysis time is preferably 5 to 750 seconds, more preferably 60 to 600 seconds. When the electrolysis time is 5 seconds or more, formation of the oxide film can become sufficient. As a result, the void having sufficient undulation degree can be formed. On the other hand, when the electrolysis time is 750 seconds or less, there is no excess thickness of the oxide film and no dissolution of the oxide film, resulting in no risk of the cohesion failure of the oxide film. Also, productivity of the surface-treated aluminum material is improved.

D. Measurement Method of Undulation Degree, Circle Equivalent Diameter, and Area Occupying Ratio For measurement of the undulation degree, the circle equivalent diameter, and the area ratio of the void, on the oxide film having the void in the present disclosure, surface observation by using a field-emission scanning electron microscope (FE-SEM, SU-8230 produced by Hitachi High-Tech Corporation) and analysis by using an image analysis software WinRoof 2015 (ver. 2.1.0 produced by Mitani Corporation) are suitably used. For SEM observation, a conductive layer such as platinum, gold, osmium, and carbon may be coated on a surface of a sample in order to prevent charge-up. Specifically, a secondary electron image of the sample of the surface-treated aluminum material, which is photographed, for example, under the conditions of 10 kV of an acceleration voltage and 100,000 times of an observation magnification, is imported in the image analysis software, to perform the image analysis by binarizing the void portion observed on the surface of the oxide film. When performing the image analysis, an operation of removing isolated points was conducted by performing closing treatment 2 times after performing binarizing treatment, so that the void portion of the oxide film was in a target range. After that, shape measurement was selected from a measurement menu, and the undulation degree, the circle equivalent diameter, and the area ratio were selected as measurement items, to measure the undulation degree, the circle equivalent diameter, and the area ratio. An average value of the measured undulation degree and the circle equivalent diameter were calculated to specify these as the undulation degree and the circle equivalent diameter on each surface. Also, from the sum of the area ratios, the area occupying ratio of the void indicating a ratio of the sum of the total void areas to the total area not considering the undulation is obtained. Here, with respect to the undulation degree, the circle equivalent diameter, and the area occupying ratio of the void are as specified above.

EXAMPLES

Hereinafter, the present disclosure will be described in detail with reference to examples. Further, the present disclosure is not limited to the following examples, and its constitution can be appropriately changed without impairing the intent of the present disclosure.

Examples 1 to 8 and Comparative Examples 1 to 5

As the aluminum material to be electrolytically treated, used was a high purity aluminum plate (aluminum material) having 100 mm in vertical×50 mm in horizontal×0.4 mm in thickness and 99.9% or more in purity. This aluminum plate was used for one electrode, and the graphite electrode of a flat plate having 200 mm in vertical×90 mm in horizontal×2.5 cm in thickness was used for the counter electrode. As shown in FIG. 2, between the counter electrode plates 5, 6 of these two graphite plates connected and opposed each other, the aluminum plate was arranged so that both surfaces of the electrode 7 of the aluminum plate were parallel to the surfaces of the counter electrode plates 5, 6 of the opposing graphite plates, respectively, and the electrolytic treatment of the aluminum plate was performed. This electrolytic treatment formed the oxide films composed of the aluminum oxide film layer of a surface side and the barrier type anodic oxide film layer of an aluminum plate side on the both sides of the aluminum plate electrode 7 each opposing to the two graphite counter electrode plates 5, 6.

For the electrolytic solution used for the electrolytic treatment, used was an aqueous solution that oxalic acid was a main component. Also, an electrolyte concentration of this aqueous solution was 0.3 mol/liter as indicated in Table 1. In an electrolytic bath containing the electrolytic solution, the aluminum plate and the both counter electrodes were arranged and a direct current electrolytic treatment was performed under the conditions shown in Table 1. Further, a longitudinal direction of the aluminum plate and the graphite counter electrodes, was coincident with a depth direction of the electrolytic bath.

TABLE 1

| | Current Density at Electrolytic Treatment (A/m$^2$) | electrolytic Treatment Time (s) | Temperature at Electrolytic Treatment (° C.) | Electrolyte Concentration in Electrolytic Solution |
|---|---|---|---|---|
| Example 1 | 100 | 300 | 60 | 0.3M Oxalic Acid |
| Example 2 | 100 | 60 | 80 | 0.3M Oxalic Acid |
| Example 3 | 100 | 600 | 80 | 0.3M Oxalic Acid |
| Example 4 | 300 | 600 | 80 | 0.3M Oxalic Acid |
| Example 5 | 100 | 300 | 80 | 0.3M Oxalic Acid |
| Example 6 | 300 | 120 | 80 | 0.3M Oxalic Acid |
| Example 7 | 100 | 120 | 80 | 0.3M Oxalic Acid |
| Example 8 | 100 | 600 | 60 | 0.3M Oxalic Acid |
| Comparative Example 1 | 500 | 600 | 20 | 0.3M Oxalic Acid |
| Comparative Example 2 | 500 | 600 | 60 | 0.3M Oxalic Acid |
| Comparative Example 3 | 100 | 600 | 40 | 0.3M Oxalic Acid |
| Comparative Example 4 | 300 | 600 | 40 | 0.3M Oxalic Acid |
| Comparative Example 5 | 500 | 30 | 80 | 0.3M Oxalic Acid |

As stated above, in Examples 1 to 8 and Comparative Examples 1 to 5, the counter electrode plate connecting switch 10 in FIG. 2 was connected and the oxide films were formed on the both surfaces of the aluminum material. After the electrolytic treatment, the aluminum material was promptly taken out from the electrolytic bath, to rinse it by pure water, and to perform natural drying in the atmosphere at room temperature after air drying by a blower.

As to the samples of the surface-treated aluminum material prepared as stated above, the following measurement and evaluation were performed.

[Measurement of Undulation Degree, Circle Equivalent Diameter, and Area Occupying Ratio, of Void when Observing Aluminum Oxide Film Layer from Surface]

For the sample of the surface-treated aluminum material of each example prepared as stated above, the undulation degree, the circle equivalent diameter, and the area occupying ratio, of the void of the aluminum oxide film layer were measured by the surface observation using FE-SEM and the image analysis using the image analysis software WinRoof 2015 (ver. 2.1.0 produced by Mitani Corporation). First, a surface secondary electron image by FE-SEM (an acceleration voltage of 10 kV) was photographed with an observation visual field of 2.5 μm×0.9 μm, and using this, performed was the image analysis by WinRoof 2015. The results were shown in Table 2. Details of the surface observation and the image analysis were as described above.

TABLE 2

| | Undulation Degree | Circle Equivalent Diameter (nm) | Area Occupying Ratio of Void (%) |
|---|---|---|---|
| Example 1 | 2.63 | 17.0 | 14.1 |
| Example 2 | 3.54 | 45.4 | 42.8 |
| Example 3 | 4.00 | 45.2 | 36.9 |
| Example 4 | 2.66 | 30.1 | 32.8 |
| Example 5 | 3.63 | 27.9 | 41.9 |
| Example 6 | 3.12 | 46.8 | 36.0 |
| Example 7 | 4.62 | 43.7 | 50.4 |
| Example 8 | 2.74 | 41.5 | 29.2 |
| Comparative Example 1 | 2.39 | 25.4 | 2.1 |
| Comparative Example 2 | 2.09 | 69.5 | 37.9 |
| Comparative Example 3 | 2.41 | 10.9 | 4.3 |
| Comparative Example 4 | 2.44 | 15.3 | 5.1 |
| Comparative Example 5 | 2.25 | 18.1 | 22.0 |

[Evaluation of Close Adhesion of Oxide Film]

A pressure-sensitive adhesive tape (No. 29) produced by Nitto Denko Corporation was attached onto the sample of the surface-treated aluminum material of each example prepared as stated above, and a tape peeling strength was measured by peeling the tape at a speed of 150 mm/min using 90° Peeling Tester (TE-3001-S produced by TESTER SANGYO CO., LTD.). Here, a road cell used in the measurement was LRU-50 N produced by NIPPON TOKUSHU SOKKI CO., LTD. Measurement results of the tape peeling strength were shown in Table 3. As to the peeling strength, 5 N/cm or more and less than 6.5 N/cm was "good"; 6.5 N/cm or more was "excellent"; and other than those was "poor". "Good" and "excellent" were decided as acceptance, and "poor" was decided as non-acceptance.

TABLE 3

| | Peeling Strength (N/cm) | Decision |
|---|---|---|
| Example 1 | 5.6 | Good |
| Example 2 | 5.6 | Good |
| Example 3 | 7.1 | Excellent |
| Example 4 | 7.9 | Excellent |
| Example 5 | 7.0 | Excellent |
| Example 6 | 6.9 | Excellent |

TABLE 3-continued

| | Peeling Strength (N/cm) | Decision |
|---|---|---|
| Example 7 | 7.1 | Excellent |
| Example 8 | 7.1 | Excellent |
| Comparative Example 1 | 3.6 | Poor |
| Comparative Example 2 | 2.3 | Poor |
| Comparative Example 3 | 3.4 | Poor |
| Comparative Example 4 | 3.6 | Poor |
| Comparative Example 5 | 3.4 | Poor |

As shown in Table 3, in Examples 1 to 8, since an average value of the undulation degree of the void of the aluminum oxide film layer was 2.5 or more, the close adhesion between the oxide film and the adhesive film was good, and thus the adhesion was decided as the acceptance.

In contrast, as shown in Table 3, in Comparative Examples 1 to 5, the surface-treated aluminum material having an oxide film structure with respect to the present disclosure was not obtained. Therefore, the close adhesion between the oxide film and the adhesive film was unsatisfactory, and thus the adhesion was decided as the non-acceptance.

Specifically, in Comparative Example 1, the temperature of the electrolytic solution in the electrolytic treatment was too low, to become weak in etching power, resulting in short in the area occupying ratio of the void of the aluminum oxide film layer, and in low in the undulation degree. Therefore, the adhesion was decided as the non-acceptance.

In Comparative Example 2, in the electrolytic treatment, high current density electrolysis of a long time was performed by using a solution of a high temperature, to become over-etching, resulting in the cohesion failure of the aluminum oxide film layer itself. As a result, the adhesion was decided as the non-acceptance.

In Comparative Example 3, the temperature of the electrolytic solution in the electrolytic treatment was low and the current density was also low, to become weak in the etching power, resulting in short in the area occupying ratio of the void of the aluminum oxide film layer, and in low in the undulation degree. Therefore, the adhesion was decided as the non-acceptance.

In Comparative Example 4, as similar to Comparative Example 3, the temperature of the electrolytic solution in the electrolytic treatment was low, to become weak in the etching power, resulting in short in the area occupying ratio of the void of the aluminum oxide film layer, and in low in the undulation degree. Therefore, the adhesion was decided as the non-acceptance.

In Comparative Example 5, in the electrolytic treatment, since the electrolysis time was short to the current density, etching of the void was insufficient, to generate a plenty of fine micropores, resulting in unsatisfactory undulation degree. As a result, the adhesion was decided as the non-acceptance.

INDUSTRIAL APPLICABILITY

According to the present disclosure, the surface-treated aluminum material excellent in the close adhesion with the bonded body of the adhesive tape, the resin, and the like, can be obtained. Thereby the surface-treated aluminum material with respect to the present disclosure is suitably used for an aluminum/resin joining member and a resin coated aluminum material that are required for the resinous close adhesion with the aluminum material.

The invention claimed is:

1. A surface-treated aluminum material comprising an aluminum material and an oxide film formed on at least part of a surface of the aluminum material, wherein, when a perimeter and an area of a void on a surface of the oxide film are represented by L and S, respectively, an undulation degree of the void defined as $L^2/S\times(1/4\times)$ is 2.5 or more, wherein a diameter of the void is 25 to 65 nm in terms of a circle equivalent diameter, the oxide film comprises a barrier anodic oxide film layer formed on at least part of the surface of the aluminum material and an aluminum oxide film layer formed on the barrier anodic oxide film layer, the void is located on a surface of the aluminum oxide film layer, and the void is a small pore extending from the surface of the aluminum oxide film layer to the inside.

2. The surface-treated aluminum material according to claim 1, wherein an area occupying ratio of the void on the surface of the oxide film is 10 to 60%.

3. The surface-treated aluminum material according to claim 1, further comprising a resin layer on the surface of the oxide film.

4. A method for producing the surface-treated aluminum material according to claim 1, wherein an acid or alkaline aqueous solution having a liquid temperature of 30 to 90° C. is used as an electrolytic solution, and wherein the oxide film is formed by performing electrolytic treatment with respect to the aluminum material so that a current density is 10 $A/m^2$ or more and 3,000 $A/m^2$ or less.

* * * * *